US005906552A

United States Patent [19]

Padilla

[11] Patent Number: 5,906,552

[45] Date of Patent: May 25, 1999

[54] BALL PITCHBACK AND REBOUND ASSEMBLY

[76] Inventor: Ronald G. Padilla, 12029 W. Tanforan Ave., Morrison, Colo. 80465

[21] Appl. No.: 08/834,604

[22] Filed: Apr. 7, 1997

[51] Int. Cl.[6] ..... A63B 69/00

[52] U.S. Cl. ..... 473/421

[58] Field of Search ..... 473/434, 475, 473/454, 462; 273/331, 342, 348, 374, 375, 390, 391, 392, 396, 407, 410; 37/584

[56] References Cited

U.S. PATENT DOCUMENTS

| | | | |
|---|---|---|---|
| 3,087,701 | 4/1963 | Wallace | 273/407 |
| 4,029,318 | 6/1977 | Boss | 273/390 |
| 4,417,728 | 11/1983 | Hay | 273/342 |
| 4,457,513 | 7/1984 | Thompson | 273/342 |
| 4,546,984 | 10/1985 | Towle | 273/407 |
| 4,553,751 | 11/1985 | Ketchum | 273/407 |
| 4,910,893 | 3/1990 | Asay | 37/284 |
| 5,242,160 | 9/1993 | Girard | 473/454 |

*Primary Examiner*—Theatrice Brown
*Attorney, Agent, or Firm*—Charles C. Corbin

[57] ABSTRACT

Disclosed is a collapsible assembly for adjustably supporting a net for pitching back, rebounding, or otherwise returning various types of game balls, the assembly including first and second U-shaped stand members, each having a cross-bar and a pair of spaced apart leg elements, the cross bar being adapted for engaging a horizontal surface such as a floor or the ground, and the upper ends of the leg elements mounted to a pair of hub plates from which the leg elements diverge at a substantial angle to form a stand. An inverted U-shaped net support member has its lower ends connected to the hub plates by way of mechanism that allows the support member to be angularly adjusted about a horizontal axis and releasably locked at a chosen orientation. The assembly is capable of being folded to a storage position in which the net support member is locked in its upright position and the two stand members are rotated to upright positions adjacent and generally parallel to the net support member, whereby the bottom of the hub plate is then engagable with a floor or the ground to support the assembly in a stable free-standing manner.

7 Claims, 2 Drawing Sheets

BALL PITCHBACK AND REBOUND ASSEMBLY

BACKGROUND OF THE INVENTION

1. Field of the Invention

The present invention relates to devices for supporting a net for pitching back or otherwise rebounding a game ball, such as a baseball or a soccer ball for example, and used as a training and practice device, and more particularly to such devices that allow the inclination of the net to be adjusted, and which are foldable for storage and transport.

2. Description of the Prior Art

There are devices available for supporting a net for the purpose of returning or restraining a sports game ball. For example such devices have been provided for footballs, soccer balls and golf balls, and others serve as a pitchback and target for baseballs and softballs. Unfortunately these devices are not without their limitations and shortcomings. Conventional support devices for nets are often in the form of metallic constructions that can be cumbersome and unwieldy, and not easy to transport and store efficiently, particularly when they cannot be collapsed or folded for that purpose. Often in such devices the inclination at which the net is held cannot be adjusted, and they are generally restricted to being used with balls of one particular sport, and do not lend themselves to being used in conjunction with a variety of sports.

SUMMARY OF THE INVENTION

In view of the foregoing, it is a general object of the present invention to provide an improved device for supporting a net for pitchback or ball return purposes.

A more particular object is to provide a ball pitchback and return assembly that supports a net in a manner that allows for quick and easy adjustment of the angle at which the net is oriented.

A further object is to provide such an assembly that can be easily folded from an in-use position to a collapsed configuration that is convenient for handling and transport, and that has a relatively narrow profile for efficient storage.

Yet another object of the present invention is to provide such a device that, in its folded configuration, is capable of supporting itself in a stable upright position.

Still another object is to provide such an improved device that can support various nets as desired, for use in association with balls of different sports.

These and other objects and advantages are provided by the present invention of a net support assembly for pitching back and rebounding a ball, the assembly including first and second U-shaped stand members, each having a cross bar and a pair of parallel leg elements, the cross bar adapted for engaging a horizontal surface such as the ground or a floor. There is a pair of laterally spaced apart combination hub and pedestal plates to which upper ends of the stand members are pivotally connected and releasably secured to hold the stand members in a position in which they form an inverted-V shaped stand. The lower ends of the hub plates are adapted to engage a horizontal surface when the assembly is collapsed to a folded position.

The assembly further includes an inverted U-shaped net-support member having a cross bar and a pair of arms with lower ends that are pivotally connected to the hub plates by means for adjusting the angle of the net-support member, and for releasably locking it at desired orientations.

The lower end of each of the support member arms is pivotally connected to the hub plate by way of a pivot connecting element, to mount the net support member for rotation about a horizontal axis.

The means for securing the net-support member at a given angular orientation include locking means, spaced a predetermined distance from the pivot element, for releasably securing the arm of the net-support member stationarily against rotation relative to the hub plate.

In a preferred embodiment of the invention, a pivot element extends from a lower end portion of each support member arm, and engages a vertically orientated oblong slot in the hub plate to mount the net-support member for rotation, and for limited vertical movement along the slot. An aperture in the hub plate above the pivot slot has an arcuate lower edge with lock notches spaced apart therealong, and the locking means includes a lock pin extending from the support arm through the aperture, and engagable in a lock notch to hold the arm against rotation. Threads on the lock pin are engaged by those of a knob that can be turned to clamp the arm to the hub plate. The vertical movement of the pivot element along the oblong slot permits the movement of the lock pin in and out of a given notch when adjustment is made.

The assembly is capable of a unique storage configuration whereby the net support member is clamped in its upright position, and the two stand members are also rotated to substantially upright positions adjacent the net support member, and the cross bar of the net support member is advantageously spaced a distance above the two cross bars of the folded stand members sufficient to allow the net support cross bar to be conveniently grasped by hand for carrying purposes, and the bottom edges of the hub plates are then engagable with a horizontal surface to serve as pedestals to support the folded assembly in a stable upright position.

DETAILED DESCRIPTION OF THE INVENTION

Figure 1:
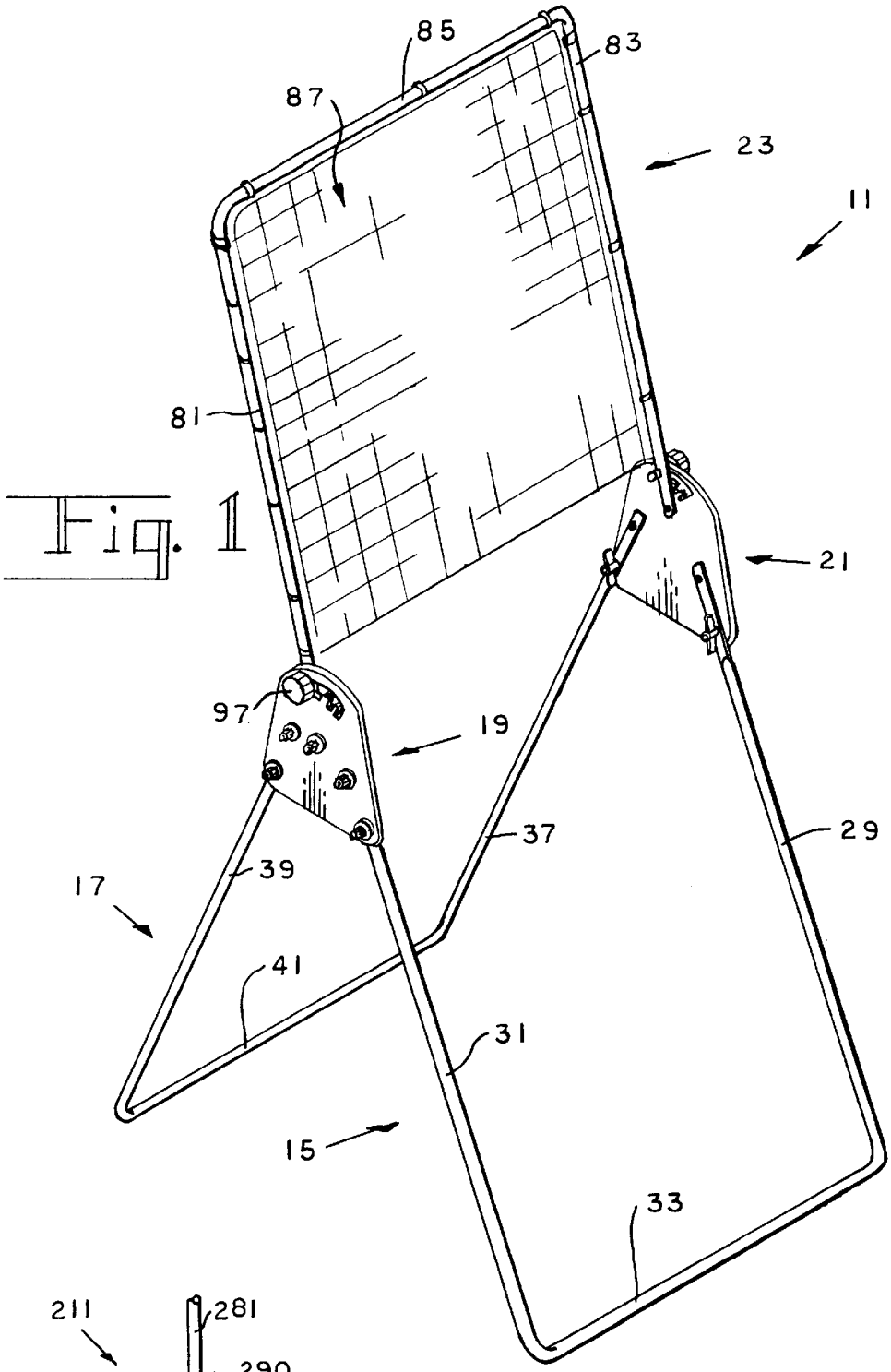
FIG. 1 is a perspective view showing a preferred embodiment of the invention in a deployed position.

Referring now to the drawings, FIG. 1 illustrates a preferred embodiment of a net support assembly 11 according to the present invention, wherein the main components include a first U-shaped stand member 15 and second U-shaped member 17, combination support hubs and pedestals 19 and 21, and an inverted U-shaped net support member 23.

Members 15, 17, and 23 are preferably constructed of a suitable tubular metal stock, and the hub plates 19 and 21 of a suitable steel plate material, and are fabricated according to conventional metal-working techniques.

The stand member 15, has legs 29 and 31, and a cross bar 33 for engaging a horizontal surface (such as a floor or the ground). The second stand member 17 has dimensions that match the stand member 15, and includes legs 37 and 39, and cross bar 41.

Figure 2:
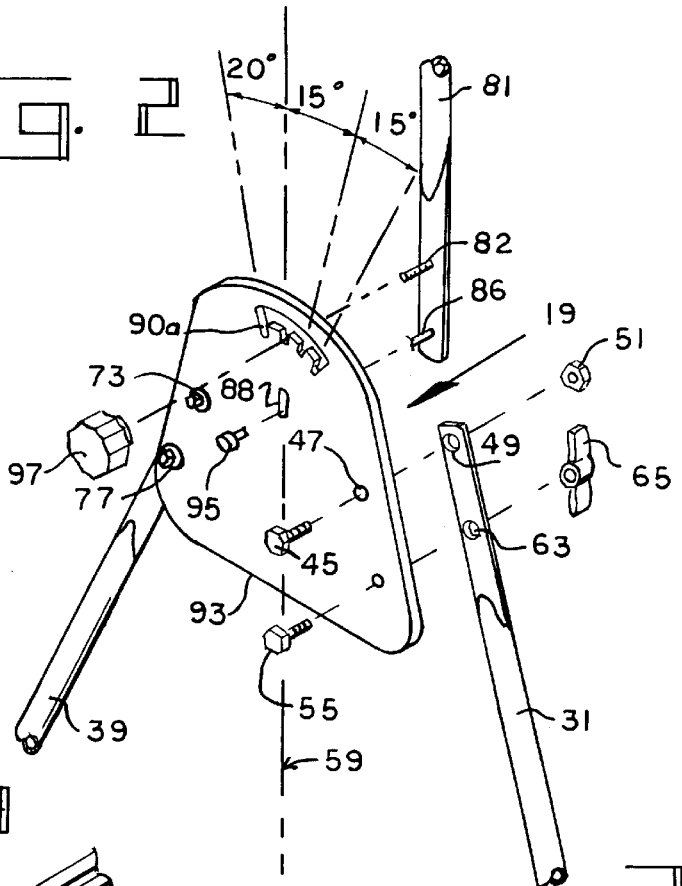
FIG. 2 is a partial, exploded, enlarged perspective view of a hub plate of the assembly of FIG. 1.

FIGS. 1 and 2 show how the flattened upper part of the leg 31 is pivotally mounted to hub plate 19 by a suitable pivot pin 45 that is engaged through hub bore 47 and bearing hole 49, and secured by nut 51. Thus the upper end of leg 31 is mounted for rotation about an axis through pin 45. Similarly a pin 53 is used to mount the upper end of the other leg 29 tithe other hub plate 21. FIGS. 1 and 2 also show that there is a threaded keeper element 55 for releasably holding bar 31 stabilized against rotation about pin 45, and at a substantial inclination to a central vertical axis 59 through hub plate 19. Element 55 engages hub plate hole 61, the bore 63 in the side bar 31, and a suitable wing nut 65 or an equivalent item such as a treaded knob, threadedly engages the threaded end of a bolt 55, and can be tightened by hand to easily and quickly secure the leg 31 stationarily to the hub plate 19. In a similar manner, the other leg 29 is releasably secured to plate 21 by use of a wing nut 71.

The upper ends of the legs 37 and 39 of the stand member 17 are pivotally connected to the hub plates 19 and 21 respectively, by pivot pins 73 and 75. Wing nut-equipped fasteners 77 and 79 engage bores in the legs and the hub plates to releasably secure the stand member 17 against rotation, and thus the assembly 11 can have a deployed position with the two stand members held at a suitably divergent orientation to each other to provide a stable stand configuration, as illustrated.

FIG. 1 shows that the net support member 23 includes arms 81 and 83, and cross arm 85, and it should be appreciated how a rebounding net 87 of conventional design can be attached over member 23. It should also be appreciated how nets of various constructions and designs, i.e. of different mesh size, resiliency and tension and other characteristics for example, can be mounted over member 23 to meet a particular application to which the assembly is used.

FIG. 2 best illustrates the structure and means for allowing angular adjustment of the net support member 23, and for releasably locking it at a chosen orientation. In this regard the flattened lower part of arm 81 is provided with a lock pin 82, and a pivot pin 86. An oblong aperture 88 is aligned with the vertical axis 59, and above it is an arcuate opening 89 that has a lower edge that is provided with several locking notches, including notches 90*a*, 90*b*, 90*c*, and 90*d*. Note that hub plate 19 has a flat bottom 93 which is designed to engage a horizontal surface when the assembly is folded to a storage position in a manner to be described hereinafter.

Pivot pin 86 is mounted in the oblong aperture 88 and it can be moved vertically therealong, and the cap 95 serves to retain the pin within aperture 88.

Note that the shaft of lock pin 82 is sized to snugly fit any of the lock notches, and when the components shown in FIG. 2 are assembled, pin 82 will be positioned at the base of a lock notch when the pivot pin 86 engages the lower end of oblong aperture 88. The vertical spacing between pins 82 and 86 is such that when arm 81 is raised to move the pivot pin to the top of aperture 89, the lock pin 82 will clear the tops of the notches.

The clamping knob 97 engages the threads of lock pin 82, and can be tightened by hand to engage the face of hub plate 19 to positively hold pin 82 positioned within a lock notch.

Note that the lock notches are orientated at various angles with respect to a radial line extending from the pivot pin through the respective notches, and notch 90*b* is engagable to hold the arm 81 in a direct upright position. Notch 90*a* is at 20 degrees to the vertical axis 59, and notches 90*c* and 90*d* are at 15 degrees and 30 degrees respectively to the other side of axis 59. While these particular angular increments are used in this embodiment of the invention, it should be understood that the invention is not limited to these angular settings, and variations of the invention can have any number of notches at various angular increments. The adjustment and locking structure at the other hub plate 21 is the mirror image of what has been described above, and thus no further decription of it is necessary.

Operation of assembly 11 will now be described. FIG. 1 shows a typical deployed position. Here the net is secured at about 20 degrees to the vertical. To change the net orientation, to a direct upright position for example, the knob 97 and its counterpart on the plate 21, are loosened. This frees the net support member 23 to be moved outwards so that the lock pin 83 clears notch 90*a*, the lock pin at the other hub plate 21 being similarly shifted. Member 23 can then be rotated to move pin 83 into alignment above notch 90*b*, and then lowered thereinto. The knobs can then be tightened to secure member 23 in the upright position. In this way the net support member 23 can be easily changed to any of several orientations, as desired for a particular ball-return or pitchback requirement.

Figure 3:
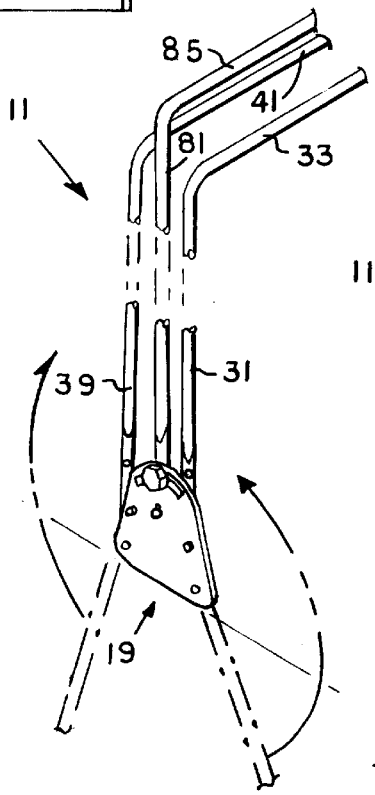
FIG. 3 is a partial perspective view of the assembly of FIG. 1.
Figure 4:
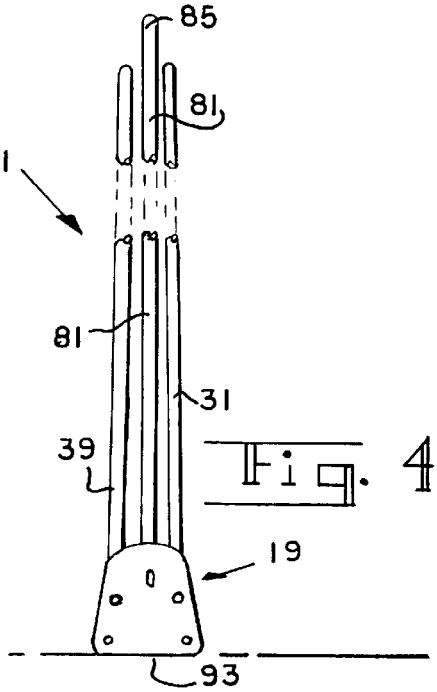
FIG. 4 is an elevational end view illustrating the folded position of the assembly of FIG. 1.

FIGS. 3 and 4 best illustrate how assembly 11 can be folded to a stable, compact configuration for easy handling and efficient storage. This folded configuration also provides the assembly the ability to be self-standing on a horizontal surface. First the net support member 23 is set in its upright position in the manner described above. Then the four wing nuts, including wing nut 65, are loosened to allow the associated lock pins to be disengaged from the respective side elements of the two stand members. Then the net support members can be rotated upwardly to generally vertical positions adjacent member 23, as illustrated. Note in FIGS. 3 and 4, that in this preferred embodiment, the cross bar 85 is spaced at a higher elevation than the cross bars 41 and 33, which spacing is sufficient to allow bar 85 to conveniently serve as a handle for carrying the folded assembly. Also note in FIG. 4 how the hub plates serve as pedestals, with their bottom edges engaging a horizontal surface to support the assembly in a stable manner in the upright position as shown.

Figure 5:
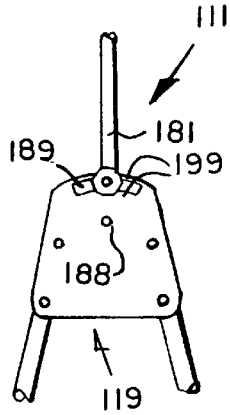
FIG. 5 is a partial side elevational view of a variant of the invention.

FIG. 5 shows a varient 111 of the invention which uses a hub plate 119 which is essentially the same as the plate 19 described above, except that here a support arm 181 is pivotally connected in a round bore at 188 and a threaded clamping knob 197, similar to 85 is spaced at a higher elevation than the cross bars 41 and 33, which spacing is sufficient to allow bar 85 to conveniently serve as a handle for carrying the folded assembly. Also note in FIG. 4 how the hub plates serve as pedestals, with their bottom edges engaging a horizontal surface to support the assembly in a stable manner in the upright position as shown.

FIG. 5 shows a varient 111 of the invention which uses a hub plate 119 which is essentially the same as the plate 19 described above, except that here a support arm 181 is pivotally connected in a round bore at 188 and a threaded clamping knob 197, similar to knob 97 above, is used to engage a knurled surface 199 adjacent the arcuate opening 189, to clamp the arm 181 at any desired orientation.

Figure 6:
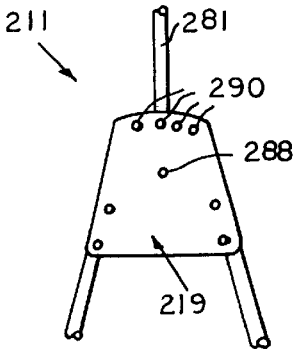
FIG. 6 is a partial side elevational view of yet another varient of the invention.

FIG. 6 shows yet another varient 211 of the invention which uses a hub plate 219 which is essentially the same as plate 119 described above, except here the plate 219 has a number of spaced-apart holes 290 that are alignable with a bore (not shown) in the support arm 281 which pivots about location 288. A threaded pin (not shown for the sake of clarity) or suitable equivalent fastener is removably engagable in aligned holes to hold the arm 281 at a chosen orientation.

While particular preferred embodiments of the invention has been described, it is to be understood that various modifications and variations of the invention may occur to those experienced in the art, given the benefit of this disclosure. Thus it is intended to cover all such changes and modifications as fall within the full scope and breath of the invention as defined by the claims which follow.

What is claimed is:

1. An assembly for adjustably supporting a ball-return net, said assembly including:

a) first and second substantially U-shaped stand members, each member having a pair of leg elements with first ends and a cross bar connecting corresponding other ends of said pair of leg elements;

b) a first and a second laterally spaced apart combination hub and pedestal plates, each plate having an upper portion and a bottom adapted for engaging a horizontal surface for supporting said plate upright, and means on said plates for mounting the first ends of said leg elements for rotation of said stand members about horizontal axes, and for releasably holding stationarily the leg elements of the first stand member and the leg elements of the second stand member spaced apart at a substantial angle to each other;

c) an inverted substantially U-shaped net-support member having a pair of arms and a cross bar connecting corresponding ends of said pair of arms; and d) means on said hub plates for mounting lower end portions of said arms for allowing said net support member to be adjusted angularly to a plurality of positions with respect to a vertical plane, including a vertical position, and for releasably locking said support member at a given angular position, and whereby said assembly is capable of a folded position with said net support member in said vertical position, and said stand members rotated upwardly to a substantially vertical position.

2. An assembly as defined in claim 1 wherein the cross bar of said net support member is spaced a predetermined distance above the cross bars of said stand members sufficient to allow said net support member cross bar to be grasped by hand when said assembly is in said folded position.

3. An assembly as defined in claim 1 wherein said means for releasably holding said arms includes means for pivotally mounting the lower end of said elements to said plate for rotation about a horizontal axis, and clamping means spaced from said arm lower end for holding said arm against movement relative to said plate.

4. An assembly as defined in claim 3 wherein said plate has a substantially arcuate edge portion that is engagable by said clamping means.

5. An assembly as defined in claim 4 wherein said clamping means includes a locking element extending from said leg element and a rotatable knob member that threadedly engages said locking element whereby said knob member is rotatable to make clamping engagement with said plate.

6. An assembly as defined in claim 4 wherein each said plate has an oblong aperture for mounting a connecting element that extends from the lower end of a support member arm, and said edge portion has a plurality of notches spaced apart therealong for receiving said locking element to hold said arm at a given orientation.

7. An assembly as defined in claim 3 including a plurality of spaced-apart holes in each of said hub plates, and wherein said clamping means includes a locking element that releasably connects said net-support member to said holes to hold said arm stationarily at a given orientation.

* * * * *